United States Patent [19]

Peate

[11] Patent Number: 4,771,830

[45] Date of Patent: Sep. 20, 1988

[54] APPARATUS FOR POSITIONING WELL TOOLS IN DEVIATED WELL BORES

[75] Inventor: William R. Peate, Broussard, La.

[73] Assignee: Schlumberger Technology Corp., Houston, Tex.

[21] Appl. No.: 44,854

[22] Filed: May 1, 1987

[51] Int. Cl.[4] ..... E21B 47/00

[52] U.S. Cl. ..... 166/241; 166/250; 175/50; 175/323

[58] Field of Search ..... 166/241, 242, 250, 264; 175/45, 50, 62, 323

[56] References Cited

U.S. PATENT DOCUMENTS

| | | | |
|---|---|---|---|
| 2,043,381 | 6/1936 | Lane | 166/117.5 |
| 3,747,701 | 7/1973 | Atkins et al. | 175/62 |
| 3,858,651 | 1/1975 | Wolk | 166/241 |
| 4,022,281 | 5/1977 | Pennock | 166/250 |
| 4,209,891 | 7/1980 | Lamb et al. | 166/341 |
| 4,375,237 | 3/1983 | Churchman | 166/117.5 |
| 4,415,030 | 11/1983 | Walkow et al. | 166/241 |
| 4,438,810 | 3/1984 | Wilkinson | 175/45 |
| 4,570,709 | 2/1986 | Wittrisch | 166/250 |
| 4,697,638 | 10/1987 | Knight | 166/250 |

*Primary Examiner*—Jerome Massie, IV
*Assistant Examiner*—Terry Lee Melius
*Attorney, Agent, or Firm*—Henry N. Garrana

[57] ABSTRACT

In the representative embodiment of the invention disclosed herein, new and improved tool-orienting apparatus is adapted to be secured on a well tool that is to be moved through a highly-deviated well bore. To assure that the well tool will remain in a selected angular orientation as it is moved in a well bore, the orienting apparatus includes a pair of oppositely-directed generally-helical guide rails that are respectively terminated in lateral projections that are eccentrically located on one side of the orienting apparatus so that the unbalanced weight of a well tool carrying the orienting apparatus will cause the tool to roll over into a selected angular orientation when the tool is being moved through a deviated well bore interval with the lateral projections riding on the lower wall of the well bore interval.

2 Claims, 3 Drawing Sheets

Fig. 1
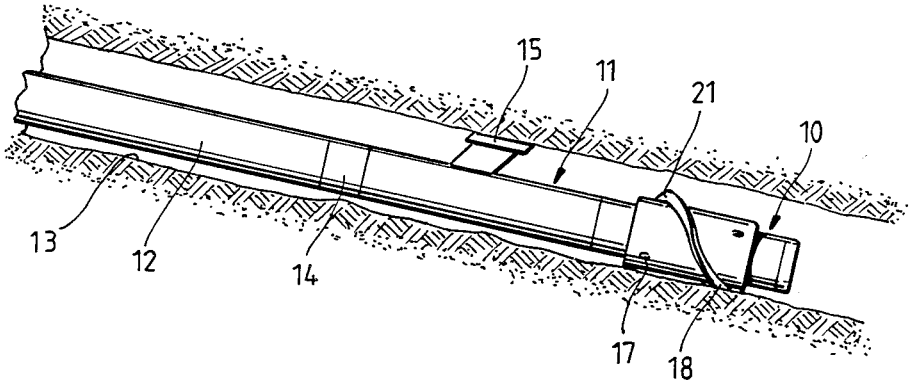
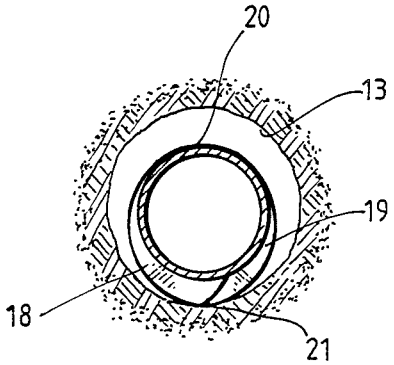
Fig. 4
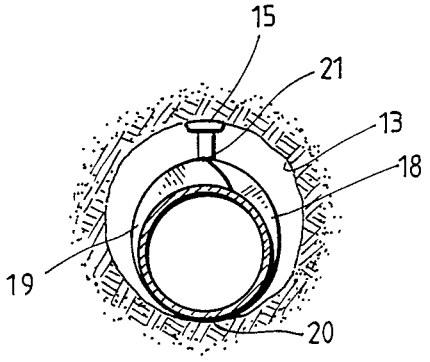
Fig. 5

APPARATUS FOR POSITIONING WELL TOOLS IN DEVIATED WELL BORES

BACKGROUND OF THE INVENTION

In drilling offshore wells, a single drilling platform is typically positioned at a central location and a plurality of wells are successively drilled in various radial directions. To direct these wells outwardly from the central platform it is, of course, essential that substantial portions of these boreholes be drilled along nearly-horizontal axes in order to reach their respective targets. It will be appreciated, therefore, that it is all but impossible to lower cable-suspended well tools to the bottom of such highly-deviated wells.

Accordingly, to move cable-suspended tools into these deviated intervals, a common operating practice is to couple the tools without a suspension cable to the lower end of a joint of drill pipe and progressively push the tools into the well bore as the string of drill pipe is successively assembled at the surface and lowered into the well bore. At some time during the assembly of the drill string, a special latching sub or a so-called "wet connect" device is coupled to the free end of the tool suspension cable and introduced into the drill string by way of a so-called "side entry" sub that is coupled into the drill string before additional joints of drill pipe are coupled thereto. Although it is not essential that the wet connect device be immediately mated with a companion device on the upper end of the well tools, this connection is typically made so that the suspension cable will be electrically connected to the well tools as they are lowered on into the well bore.

It will be appreciated that once the cable has been connected to the well tools and the tools have reached the bottom of the well bore, the tools are in readiness to be operated as needed for carrying out their intended operations. For instance, when one or more logging tools are coupled to the lower end of the drill string, the logging tools will progressively log the open borehole below the casing string by alternately raising the drill string and removing successive stands of the drill pipe from the upper end of the drill string. Once the side entry sub is brought to the surface, the wet connect device is disconnected and the cable is removed.

Those skilled in the art recognize that some logging tools include a wall-engaging member which must be positioned firmly against the borehole wall in order for the logging tool to operate properly. Similarly, other types of logging tools employ extendible wall-engaging members which must be moved outwardly into engagement with a borehole wall. Nevertheless, if one of the latter logging tools is oriented in a substantially-inclined interval of a borehole so that the wall-engaging member is facing downwardly, the weight of the tool string will prevent the member from been extended outwardly as necessary for the tool to operate in that interval of the borehole. Regardless of the type of wall-engaging member employed, it will be recognized that there has been no practical way heretofore for reliably positioning one of these tools in a selected orientation as it is passed through a highly-deviated borehole interval.

OBJECTS OF THE INVENTION

Accordingly, it is an object of the present invention to provide new and improved tool-orienting apparatus which is adapted for mounting on a dependently-suspended well tool and is cooperatively arranged to turn the tool about its longitudinal axis as the well tool is moved along a substantially-horizontal borehole interval until the tool body is positioned in a predetermined angular orientation.

SUMMARY OF THE INVENTION

This and other objects of the present invention are attained by arranging a tool body that is free to turn about its longitudinal axis with at least one rib extending partway around the body and terminating in an eccentrically-located projection that defines a wall-engaging surface on one side of the body that will cause the body to be rotated about its longitudinal axis until the body reaches a stable position in which another wall-engaging surface on the opposite side of the body is resting on the lower side of the borehole as the body is being moved through a substantially-horizontal borehole interval.

BRIEF DESCRIPTION OF THE DRAWINGS

The novel features of the present invention are set forth with particularity in the appended claims. The invention, together with further objects and advantages thereof, may be best understood by way of the following description of an exemplary embodiment of new and improved apparatus employing the principles of the invention as depicted in the accompanying drawings, in which:

FIG. 1 schematically depicts a typical well-logging tool coupled to a preferred embodiment of new and improved tool-orienting apparatus incorporating the principles of the present invention as this assembly will appear when it is dependently coupled to a drill string and is being moved thereby through a borehole;

FIGS. 4 and 5 are cross-sectional views of the tool-orienting apparatus of the invention schematically depicting the operation of the tool-orienting apparatus as it functions to turn the well-logging tool about its longitudinal axis until it has reached a predetermined angular orientation in a borehole.

DETAILED DESCRIPTION OF THE INVENTION

Figure 2:
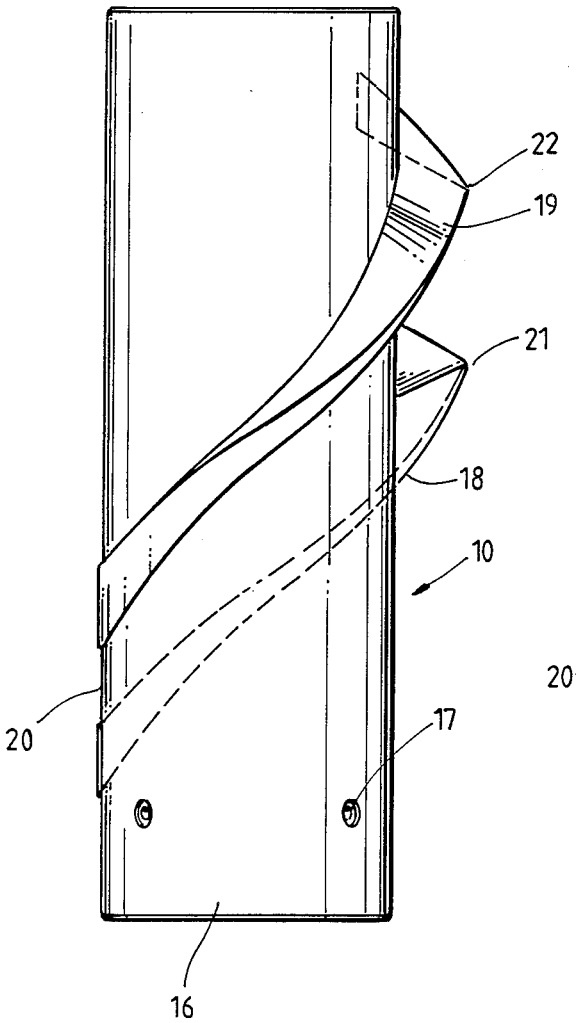
FIGS. 2 and 3 elevational and cross-sectional views of the preferred embodiment of the new and improved tool-orienting apparatus shown in FIG. 1.
Figure 3:
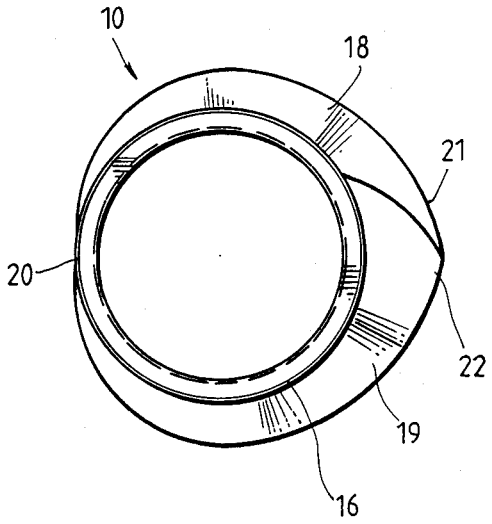

Turning now to FIG. 1, new and improved orienting apparatus 10 of the present invention is schematically depicted as it will appear when it is mounted on the lower end of a well tool such as a typical logging tool 11 that is coupled to the lower end of a drill string 12 that is supported by a drilling rig (not seen in the drawings) that is being selectively operated to raise the drill string as needed for pulling the tool through a substantially-horizontal borehole interval 13. To be assured that the logging tool 11 can turn freely in relation to the drill string 12, the tool is dependently coupled to the drill string by way of a typical swivel connection 14.

Although the new and improved tool-orienting apparatus 10 may be employed with all types of well tools, to illustrate a typical operation of the tool-orienting apparatus 10, the logging tool 11 is depicted as including an extendible pad member 15 that must be engaged against the wall of the borehole 13 in order for the logging tool to operate properly. It will, of course, be recognized by those skilled in the art that should the logging tool 11 happen to be oriented so that the pad member 15 is facing downwardly as the logging tool is moving through the borehole 13, the weight of the tool will ordinarily be so great that the pad member cannot be extended. Moreover, even if the pad 15 can be extended against the lower surface of the borehole 13, as the tool 11 is moved along the borehole interval the body will be unbalanced and will correspondingly turn about its longitudinal axis until the logging tool is riding on the lower edge of the pad member and an adjacent wall surface of the tool body.

Turning now to FIG. 2, an elevational view is shown of a preferred embodiment of the new and improved tool-orienting apparatus 10. As illustrated, the tool-orienting apparatus 10 is comprised of an elongated body which is preferably arranged as a tubular member 16 that is appropriately sized to be fitted over one portion of the body of the logging tool 11. Since the tool body 16 must be retained in a selected angular position on the body of the logging tool 11, means such as one or more set screws 17 are cooperatively arranged in the tool body for releasably securing it to the logging tool. In this manner, once the tool body 16 has been slipped over the body of the logging tool 11 and appropriately positioned in relation to the extendible pad member 15, the set screws 17 can be tightened to secure the orienting apparatus 10 on the logging tool.

In keeping with the objects of the invention, in the preferred embodiment of the new and improved tool-orienting apparatus 10, a set of projections or ribs 18 and 19 are arranged on the body 16 so that the ribs begin at a common wall-engaging surface 20 on one side of the body and are arranged as generally-helical guides that respectively extend in opposite directions halfway around the body to a terminal projection, as at 21 and 22, that is diametrically opposite from the common wall-engaging surface 20. As best seen in FIG. 2, in the depicted preferred embodiment of the tool-orienting apparatus 10, the ribs 18 and 19 are each fashioned so that their outer edges define wall-engaging surfaces that are progressively narrowed as well as uniformly displaced further outwardly from the tool body 16 so that the edges of the outstanding projections 21 and 22 will respectively represent the narrowest part of the guides as well as be at the furtherest lateral distance from the tool body.

It should be noted that although it is the height of these outstanding projections 21 and 22 that serves to unbalance the logging tool 11 so that it will begin to turn over whenever one of these projections is riding along the lower surface of a highly-deviated borehole interval, as at 13, it is the generally-helical configuration of the rails 18 and 19 which will impart a turning action on the tool body 16 that is sufficent to roll the tool body over onto its wall-engaging surface 20 as one or the other rail is riding along the lower surface of the borehole interval. Once the logging tool 11 is oriented as intended it will be recognized that the guides 18 and 19 will cooperate to keep the wall-engaging surface 20 moving along the lower surface of a deviated borehole interval as at 13.

Turning now to FIGS. 4 and 5, to illustrate the way in which the new and improved tool-orienting apparatus 10 of the present invention will function as it is moving through a highly-deviated borehole interval, as at 13, a schematic view is shown of the borehole, the tool-orienting apparatus and the pad member 15 of the logging tool 11. As seen in FIG. 4, wben tbe tool-orienting apparatus 10 is positioned in the borehole interval 16 so that the pad member 15 is not properly oriented in relation to the borehole, the outstanding projections 21 and 22 of the ribs 18 and 19 will be riding on the lower surface of the borehole. As schematically represented in FIG. 4, it will be appreciated that so long as the narrow projections 21 and 22 are riding on the lower surface of the borehole interval 13, the logging tool 11 will be in an unstable position and will be inclined to roll over in either direction. Accordingly, as seen in FIG. 5, it will be appreciated that once the tool-orienting apparatus 10 has caused the logging tool 11 to roll over in relation to the lower wall of the borehole interval 13, the unique configuration of the ribs 18 and 19 will cooperate to position the logging tool in an angular orientation that will allow the pad member 15 to extend outwardly as needed to properly log the formations traversed by the borehole interval.

It will be appreciated, therefore, that the new and improved tool-orienting apparatus 10 of the present invention is cooperatively arranged so that as a logging tool, as at 11, that is either coupled to the tool-orienting apparatus as shown in the drawings or which carries integral guides or ribs, as at 18 and 19, is moved through a deviated borehole interval, the logging tool will always be maintained in a predetermined angular position. Thus, by virtue of the unique configuration of the ribs 18 and 19, the logging tool will be caused to turn from an unbalanced angular position to a balanced angular position in relation to the borehole interval for reliably maintaining the logging tool in a predetermined angular orientation.

While only a single embodiment of the present invention has been illustrated and described herein, it is apparent that various modifications and changes may be made without departing from the principles of this invention in its broader aspects; and, therefore, the aim in the appended claims is to cover such modifications and changes as fall within the spirit and scope of this invention.

What is claimed is:

1. Well bore apparatus comprising:

a well tool adapted to be dependently suspended from a pipe string and moved through a highly-deviated well bore; and tool-orienting means including a body coupled to said well tool and including first and second opposite-handed generally-helical rails respectively directed in opposite directions around said body and extending from a selected wall-engaging surface on one side of said body to first and second projections on the opposite side of said body defining an eccentrically-located wall-engaging surface adapted to cause the unbalanced weight of said well tool to roll said well tool over onto said selected wall-engaging surface whenever said well tool is being moved along a deviated well bore with said eccentrically-located wall-engaging surface in contact with the lower wall of a deviated well bore.

2. Well bore apparatus comprising:

a tubular body adapted to be mounted on the body of a well tool; means cooperatively arranged and adapted for releasably securing said tubular body on the body of a well tool; and tool-orienting means on said tubular body including first and second generally-helical rails directed in opposite directions around said tubular body and extending between a selected wall-engaging surface on one side of said tubular body and sloping outwardly therefrom and respectively defining first and second lateral projections on the opposite side of said body defining an eccentrically-located wall-engaging surface cooperatively located to cause the unbalanced weight of said well tool to roll said well tool over onto said selected wall-engaging surface whenever said well tool is being moved along a deviated well bore with said eccentrically-located wall-engaging surface in contact with the lower wall of a deviated well bore.

* * * * *